US005490748A

United States Patent [19]

Hapeman

[11] Patent Number: 5,490,748

[45] Date of Patent: Feb. 13, 1996

[54] REVERSIBLE RAIL CAR STANCHION

[75] Inventor: Martin J. Hapeman, Edinboro, Pa.

[73] Assignee: General Electric Company, Erie, Pa.

[21] Appl. No.: 369,223

[22] Filed: Jan. 6, 1995

[51] Int. Cl.[6] ..... B60P 3/07

[52] U.S. Cl. ..... 410/64; 410/58

[58] Field of Search ..... 410/56–64

[56] References Cited

U.S. PATENT DOCUMENTS

| | | | |
|---|---|---|---|
| 3,606,219 | 9/1971 | Hammonds et al. | 410/61 X |
| 3,854,423 | 12/1974 | Bridge | 410/64 X |
| 4,095,766 | 6/1978 | Hicks, Jr. et al. | 410/61 X |
| 4,230,431 | 10/1980 | Stoller et al. | 410/59 |
| 4,264,250 | 4/1981 | Niggemeier | 410/58 |
| 4,573,843 | 3/1986 | Hesch et al. | 410/56 X |
| 4,626,154 | 12/1986 | Hesch et al. | 410/56 |
| 5,017,065 | 5/1991 | Krug et al. | 410/58 |

*Primary Examiner*—David A. Bucci
*Attorney, Agent, or Firm*—Marvin Snyder

[57] ABSTRACT

A stanchion for supporting a semi-trailer for transport on a bed of a rail car comprises a generally vertically-oriented support member having a base end and a top end, with a fifth wheel mounted to the top end. A diagonal strut attached to the support member extends angularly downward. A first plate member is positioned on the rail car bed and has a first pin extending therethrough and into the rail car bed for pivotally attaching the plate member to the rail car. A second pin extends through the plate member and into the rail car bed to prevent rotation of the plate member about the first pin. Flanges on a top surface of the plate member are attached to the support member and the strut, allowing orientation of the fifth wheel to be reversed by rotating the plate member about the first pin. The stanchion may include a second plate member attached to the top end of the support member beneath the fifth wheel, with the fifth wheel being pivotally mounted to the second plate member so that the fifth wheel is independently reversible.

15 Claims, 3 Drawing Sheets

Fig. 2A
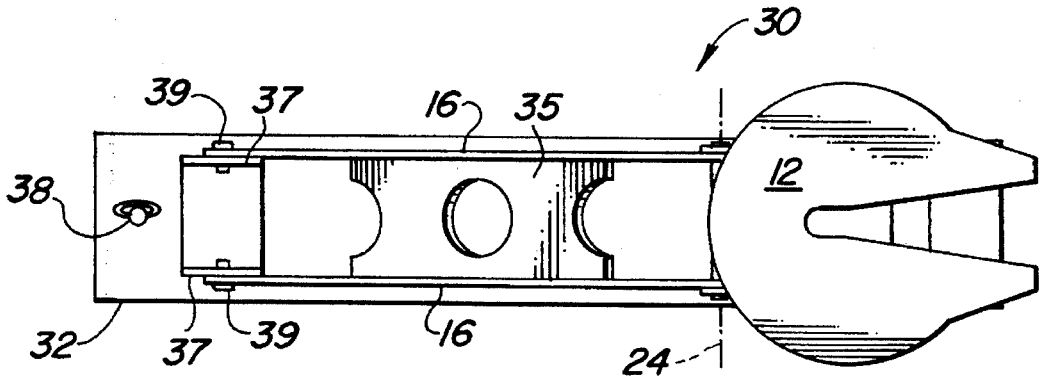
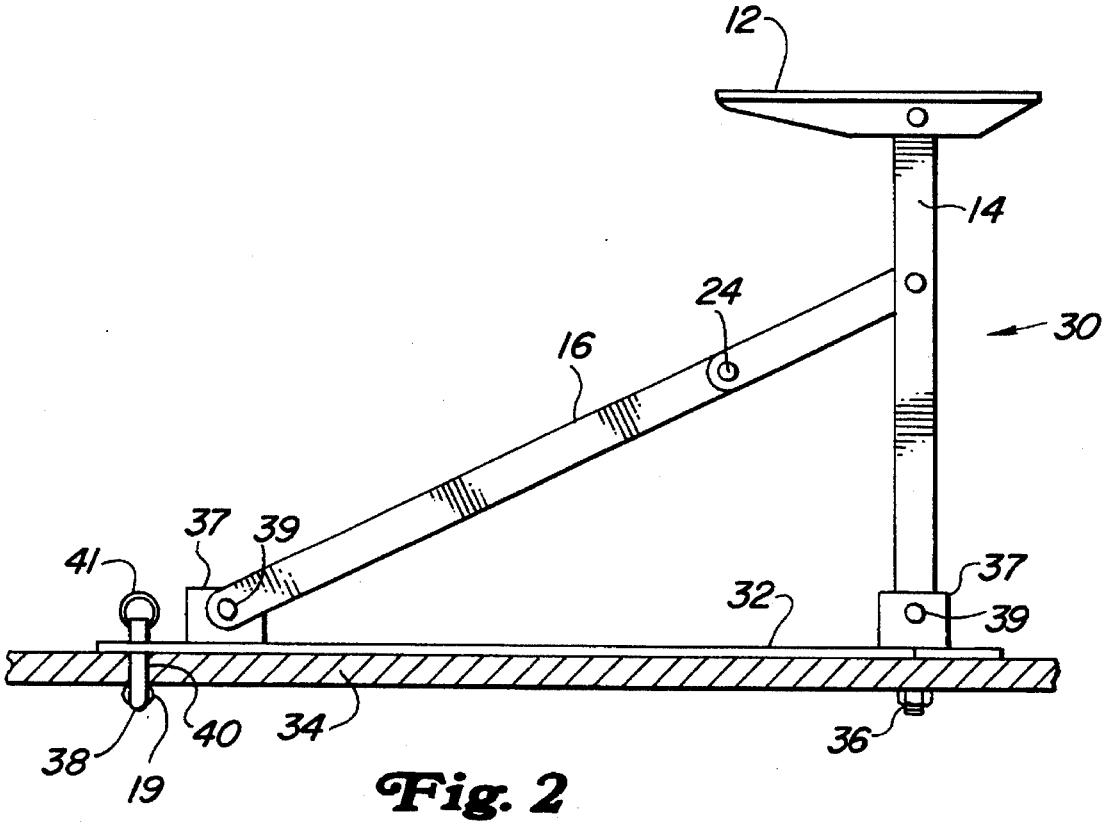
Fig. 2

REVERSIBLE RAIL CAR STANCHION

BACKGROUND OF THE INVENTION

This invention relates to a stanchion for use on intermodal rail cars, and, more particularly, to such stanchion which is reversible to allow semi-trailers to be supported while facing either forward or aft of the rail car.

Stanchions for use on intermodal railway cars are well known in the art. Typically, these stanchions are used on so-called "piggy back" intermodal rail cars to secure over-the-road trailers on the rail car. In recent years, railroads have developed large terminals for handling intermodal shipments in which the trailers are lifted on and off the car either by means of a bridge crane straddling the track, or by means of large fork lifts or the like. In certain applications, to give shippers additional flexibility, such intermodal cars are designed to handle large containers as well as over-the-road trailers. So that the rail car may have this dual use capability, it is necessary that the stanchion be retractable so that it will not interfere with the container when the rail car is used to transport containers. Typically, these retractable stanchions are moved from their lowered or retracted position to their erected or raised position either manually, through use of a manually operated screw jack mechanism or the like, or are erected using the crane to lift the retracted hitch.

Typically, a retractable stanchion includes a first or generally vertical strut and a second or diagonal strut. The upper ends of these struts are pivotally connected to a hitch head which serves as a fifth wheel for supporting the front end of the trailer and for positively holding the trailer on the rail car. The hitch head includes releasable jaws or the like for positively engaging the king pin of the trailer. The stanchion is typically the only means holding the trailer in place on the rail car when it is underway. At the rail car destination, the hitch head is actuated to release the trailer kingpin so as to permit the trailer to be off-loaded.

In addition to the manually operable or crane operable retractable stanchion described above, another known stanchion is referred to as a tractor operated stanchion. As an alternative to utilizing a crane or other lifting equipment to load and off load trailers from an intermodal railway car, it is well known to use a "circus" loading/off-loading technique in which a trailer coupled to a tractor is driven lengthwise onto the rail cars and from one car to another until reaching a desired position. The tractor engages a retracted stanchion on the car, raises the stanchion, and transfers the trailer from the tractor to the raised stanchion. Likewise, in off-loading a trailer, the tractor actuates a retraction mechanism for the stanchion and transfers the trailer from the stanchion to the tractor while permitting the stanchion to move to its retracted position.

One significant problem experienced with circus loading using prior art stanchion systems is assuring that all cars in an intermodal train are arranged such that the stanchions are located at a position on the rail car in alignment with an end of a semi-trailer to be supported. More particularly, as the semi-trailers are driven onto the rail cars, usually from one end of the train of cars, the trailers are all aligned in the same direction. If a rail car is reversed in the train, the stanchion will not be oriented in the right direction to accept a kingpin on the semi-trailer. Accordingly, it is desirable to provide a method and apparatus for reversing stanchion orientation without reversal of the associated rail car.

SUMMARY OF THE INVENTION

An object of the present invention to provide a method and apparatus for reversing a stanchion or hitch orientation on a flat bed of a rail car without reversal of the associated rail car.

Briefly, in accordance with a preferred embodiment of the invention, a collapsible stanchion for supporting a semi-trailer for transport on the bed of a rail car comprises a vertical support member and a diagonal strut, each of which is pivotally coupled to a rotatable base. The base is attached to the floor of a flat bed rail car by a pin which prevents vertical motion but allows for rotation of the base about the pin. A second pin displaced from the first pin is inserted through the base and into the rail car to prevent rotation of the base until the second pin is released. The entire stanchion can be reversed in orientation on the flat bed rail car by simply pulling the second pin and rotating the base about the pin 180°. Alternatively, a fifth wheel is mounted on an intermediate plate which, in turn, is rotatably mounted at the top of the vertical support member so that it can be rotated to control the orientation of the attached fifth wheel. The plate may be mounted using a pin or shoulder bolt as an axis of rotation and a second pin passing through both the plate and the top of the vertical support member to prevent undesired rotation. The fifth wheel is preferably pivotally mounted to the plate in a manner that allows the fifth wheel to pivot about a horizontal axis so as to facilitate attachment to a semi-trailer and to provide a relatively easy method for reversing orientation of the fifth wheel for attachment to a semi-trailer when the stanchion is so arranged that it does not interfere with positioning of a yard tractor hauling the semi-trailer into position on the rail car.

BRIEF DESCRIPTION OF THE DRAWINGS

For a better understanding of the present invention, reference may be had to the following detailed description taken in conjunction with the accompanying drawings in which:

FIG. 2 is an elevation view of a stanchion constructed and mounted in accordance with the invention;

FIG. 2A is a top plan view of the stanchion of FIG. 2;

DETAILED DESCRIPTION OF THE INVENTION

Figure 1:
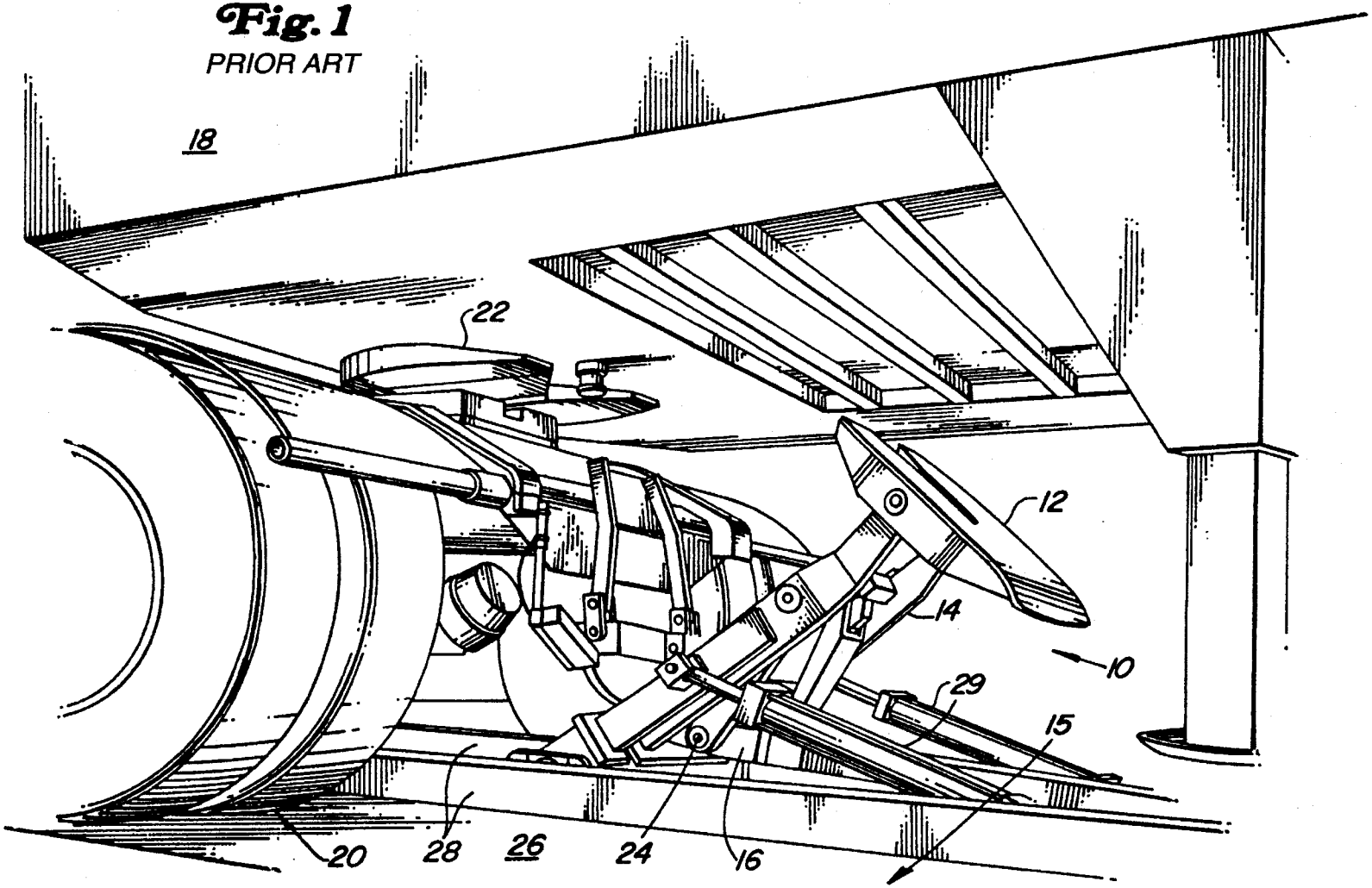
Fig. 1 PRIOR ART
FIG. 1 is a simplified illustration showing a conventional stanchion or hitch in a partially retracted position beneath a semi-trailer being transported by a yard tractor.

FIG. 1 shows a conventional retractable hitch or stanchion 10 of the type used on flat bed rail cars for rail transport of highway semi-trailers. such hitches are shown, for example, in U.S. Pat. No. 4,230,431. When in use, conventional hitches or stanchions are normally retracted so that they do not interfere with loading of semi-trailers onto the rail cars. For circus loading, i.e., when the rail cars are of the articulated type allowing tractors to drive trailers over the extent of a train of cars, the hitches are retracted to allow the tractor and trailer to pass unimpeded over the hitches. When the trailer is positioned on a rail car for transport, the hitch is raised such that a fifth wheel 12 at the top of the hitch is locked into an orientation for engaging a kingpin on the trailer and supporting the trailer for transport. The hitch typically constitutes only fastening means between the rail car and trailer. The hitch may be manually operated through a hydraulic or pneumatic actuator, or may be spring loaded and operated by the tractor. Both manually and tractor-operated hitches include at least one pivotally mounted vertical support member 14 and at least one releasable diagonal strut 16.

As shown in FIG. 1, hitch 10 has just been released from a trailer 18 by a yard tractor 20 which now supports the trailer on its own fifth wheel 22. Strut 16 has folded at axis 24 so that vertical support member 14 is in the process of folding downward onto the bed 26 of a rail car 15. The hitch is positioned between a pair of guides 28 which help guide the trailer onto the rail car. Shock absorbers 29 are attached to the sides of hitch 10 to prevent the hitch from falling without restraint when the yard tractor bumps into the release mechanism (not shown) which, when thus pushed, allows hitch 10 to fall.

As previously discussed, circus loading of rail cars requires that a yard tractor or hostler couple to a semi-trailer and then back the trailer onto a train of rail cars by backing up a ramp at one end of the train. The articulated rail cars in an intermodal train are typically 28 feet to 60 feet in length. Semi-trailers likewise vary in length from about 28 feet to about 60 feet with a length of 56 feet being quite common so that one trailer may extend over two 28-foot rail cars. As trailers are loaded, it is desirable to achieve as high a density as possible both to maximize use of available space and to reduce wind resistance caused by large gaps between trailers. So long as all the hitches are aligned to receive the trailers from one direction, loading can proceed without difficulty. However, if one or more rail cars are reversed, which is possible due to the different locations from which rail cars are obtained to make up a train, the hitches on such cars will be facing the wrong direction for coupling to the trailers. In some instances, the stanchion or hitch may be accessible with only the reversed fifth wheel being a problem. In other instances, diagonal strut 16 may interfere with positioning of the trailer, particularly for those hitches which are operated by the hostler or yard tractor.

Figure 2B:
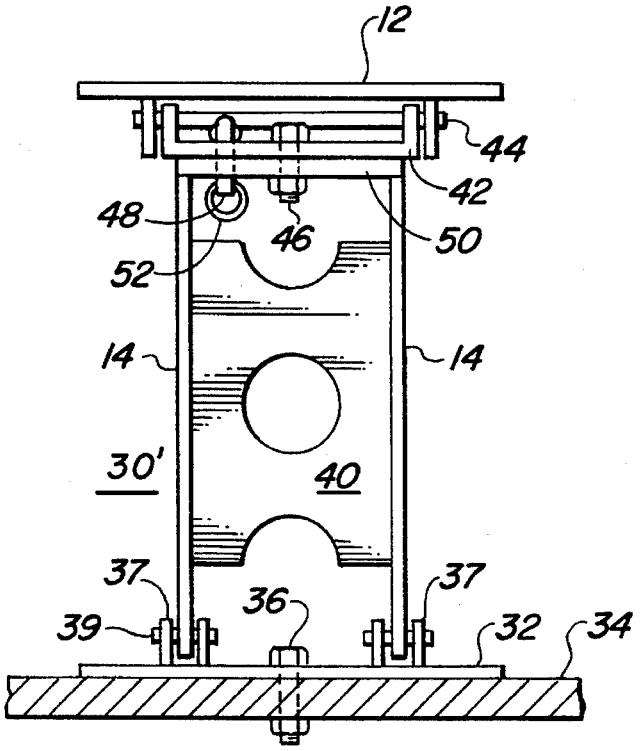
FIG. 2B is an end view of the stanchion of FIG. 2 illustrating the mounting of the plate to a rail car and the mounting of the fifth wheel to the top of the stanchion vertical support.

FIGS. 2 and 2A are a side elevation view and a plan view, respectively, of a hitch or stanchion 30 in accordance with the present invention. Struts 16 are preferably braced by a cross member, such as a plate 35, welded to each of struts 16 at a location intermediate their ends. Similarly, though not visible in FIGS. 2 and 2A, but shown in FIG. 2B, vertically-oriented support members 14 are preferably braced by a cross member 40, welded to each of members 16 at a location intermediate their ends. Stanchion 30 is mounted on a plate 32 which is attached to a floor or bed 34 of a rail car by a large pin 36. Support flanges 37 are welded to plate 32 and pins 39 pass through flanges 37 to pivotally mount struts 16 and support 14 to plate 32. Pin 36 is situated between, and in alignment with, vertical supports 14 and may be a shoulder bolt of the type commonly used for axles or other type of pin well known in the art. A shoulder bolt is particularly well adapted since it also provides for retention of plate 32 in a manner which allows for easy removal. Since pin 36 prevents plate 32 from movement in all directions except for rotation on the bed of the rail car, at least one other pin 38 through plate 32 is provided to prevent such rotation. Pin 38 may be a conventional spring-loaded locking pin of the type having a central spring-loaded member (not shown) which releases the pin when pulled, the spring operating against a pair of spherical bearings 19 which protrude partially from the sides of the pin. Pin 38 extends through a hole in plate 32 and into a hole 40 drilled or cut into the bed of the rail car and may include a bail 41 for manually pulling/releasing the pin. The entire stanchion 30 is reversible merely by releasing pin 38 and rotating the plate 32 about pin 36.

In an alternative form, as shown in the front elevation view of FIG. 2B, stanchion 30' includes a top plate 42 attached to fifth wheel 12 by means of a through pin or axle 44, allowing fifth wheel 12 to pivot about a horizontal axis to an extent sufficient to permit easy attachment of fifth wheel 12 to a king pin (not shown) on the underside of a semi-trailer. Top plate 42 is mounted to stanchion 30 by a central pin 46, such as a shoulder bolt, which allows fifth wheel 12 to rotate in a horizontal plane to reverse its orientation. One or more releasable pins 48, shown as a single, conventional spring-loaded locking pin, pass through plate 42 and into a cross-member 50 affixed to the top of stanchion support members 14 as by welding, for example, to prevent fifth wheel 12 from rotating unless pin 48 is manually released. Pin 48 may include a bail 52 for manually pulling the pin.

Figure 3:
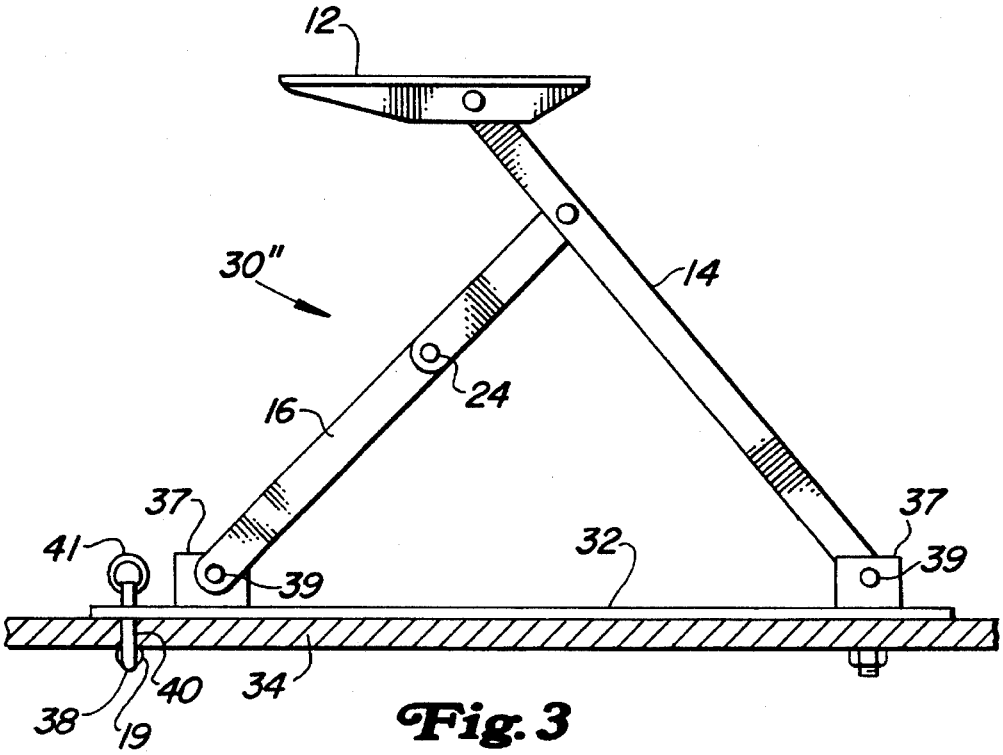
FIG. 3 is an elevation view of an alternative stanchion incorporating features of the present invention.

FIG. 3 is an elevation view of a slightly modified form of stanchion 30" in which support members 14 extend diagonally toward struts 16 even when fifth wheel 12 is in an upright and locked position. In this embodiment, the horizontal distance between flanges 37 remains the same as in the embodiment of FIG. 2, but vertical support members 14 are angularly oriented toward struts 16 and proportionately longer to keep fifth wheel 12 at the same height as shown in the embodiment of FIG. 2. Struts 16 are also shorter to accommodate the angular orientation of generally vertical support members 14. In this embodiment, the triangular base for fifth wheel 12 is drawn more directly under the fifth wheel. The advantage of this embodiment is that neither support members 14 nor struts 16 should interfere with the yard tractor as it transfers a semi-trailer onto the stanchion and therefore only the fifth wheel may need to be rotated for attachment to the semi-trailer. In this embodiment, the stanchion vertical support members and struts may be attached directly to the rail car bed since rotatable base 32 should be unnecessary and can be omitted even though shown in FIG. 3.

When semi-trailers are loaded onto rail cars using the above described reversible hitches or stanchions, a reversed rail car is not a detriment since the orientation of the stanchions can be easily reversed.

While the invention has been described in what is presently considered to be a preferred embodiment, many variations and modifications will become apparent to those skilled in the art. Accordingly, it is intended that the invention not be limited to the specific illustrative embodiment but be interpreted within the full spirit and scope of the appended claims.

What is claimed is:

1. A stanchion for supporting a semi-trailer for transport on a bed of a rail car comprising:

a generally vertically-oriented support member having a base end and a top end;

a fifth wheel mounted to said top end of said vertically-oriented support member;

a diagonal strut attached to said vertically-oriented support member near said top end and having a base end, said strut extending angularly downward from said vertically-oriented support member;

a plate member positioned on a rail car bed, said plate member including a first pin extending therethrough and through said rail car bed for pivotally mounting said plate member to said rail car, and further including a second pin releasably extending through said plate member and into said rail car bed for preventing rotation of said plate member; and attachment means mounted to a top surface of said plate member for attaching the base end of said vertically-oriented support member and the base end of said diagonal strut to said plate member, whereby the orientation of said fifth wheel is reversible by rotation of said first plate member about said first pin.

2. The stanchion of claim 1 including a second generally vertically-oriented support member having a base end and a top end, said fifth wheel being additionally mounted to said top end of said second vertically-oriented support member, and a second diagonal strut having a base end and being attached to said second vertically-oriented support member near said top end thereof and extending angularly downward therefrom, the base ends of said second vertically-oriented support member and said second diagonal strut being attached to said attachment means.

3. The stanchion of claim 2 including a cross member affixed to each of said vertically-oriented support members intermediate their ends.

4. The stanchion of claim 1 wherein said first pin comprises a shoulder bolt.

5. The stanchion of claim 1 including a second plate member attached to said top end of said vertically-oriented support member beneath said fifth wheel, said fifth wheel being pivotally mounted to said second plate member.

6. The stanchion of claim 5 including a center pin rotatably attaching said second plate member to said vertically-oriented support member, and a release pin positioned to couple said second plate member to said vertically-oriented support member to prevent rotation of said second plate member while said release pin is so positioned.

7. The stanchion of claim 2 wherein said first pin comprises a shoulder bolt.

8. The stanchion of claim 2 including a second plate member attached to said top ends of said vertically-oriented support members beneath said fifth wheel, said fifth wheel being pivotally mounted to said second plate member.

9. The stanchion of claim 8 including a second cross member affixed to the top ends of said vertically-oriented support members, a center pin rotatably attaching said second plate member to said second cross member, and a release pin positioned to couple said second plate member to said second cross member to prevent rotation of said second plate member while said release pin is so positioned.

10. A stanchion for supporting a semi-trailer for transport on a bed of a rail car comprising:

a generally vertically-oriented support member having a base end and a top end, said base end being attached to a rail car bed;

a plate member rotatably attached to said top end of said vertically-oriented support member;

a fifth wheel pivotally mounted to said plate member;

a diagonal strut attached to said vertically-oriented support member near said top end and extending angularly downward to an attachment point on said rail car bed;

a center pin rotatably attaching said plate member to said vertically-oriented support member; and a release pin positioned to couple said plate member to said vertically-oriented support member to prevent rotation of said plate member while said release pin is so positioned.

11. The stanchion of claim 10 wherein said vertically-oriented support member extends diagonally toward said strut at an angle sufficient to prevent interference with attaching a semi-trailer to said fifth wheel.

12. The stanchion of claim 10 and including a second plate member positioned on said bed of a rail car, said second plate member including a pivot pin extending therethrough and through said rail car bed for pivotally mounting said second plate member to said rail car, and further including an additional pin releasably extending through said second plate member and into said rail car bed for preventing rotation of said second plate member; and attachment means mounted to a top surface of said second plate member for attaching the base end of said vertically-oriented support member and a base end of said diagonal strut to said second plate member, whereby the orientation of said fifth wheel is reversible by rotation of said second plate member about said pivot pin.

13. A stanchion for supporting a semi-trailer for transport on a bed of a rail car comprising:

first and second generally vertically-oriented support members each having a base end and a top end, the base ends being attached to a rail car bed;

a plate member rotatably attached to said top ends of said vertically-oriented support members;

a fifth wheel situated above said plate member and being pivotally mounted to said plate member;

first and second diagonal struts attached, respectively, to said first and second vertically-oriented support members near said top ends thereof and extending angularly downward to respective attachment points on said rail car bed;

a cross member affixed to the top ends of said first and second vertically-oriented support members;

a center pin rotatably attaching said plate member to said cross member; and a release pin positioned to couple said plate member to said cross member to prevent rotation of said plate member while said release pin is so positioned.

14. The stanchion of claim 13 including a second cross member affixed to said first and second vertically-oriented support members intermediate their ends.

15. The stanchion of claim 14 including a third cross member affixed to said first and second diagonal struts intermediate their ends.

* * * * *